United States Patent [19]

Yonkers

[11] 4,279,522

[45] Jul. 21, 1981

[54] HIGH SPEED PRINTER CARTRIDGE

[75] Inventor: Edward H. Yonkers, Newton, Mass.

[73] Assignee: Data Packaging Corporation, Cambridge, Mass.

[21] Appl. No.: 967,385

[22] Filed: Dec. 7, 1978

[51] Int. Cl.[3] ..... B41J 33/10

[52] U.S. Cl. ..... 400/196.1; 400/195

[58] Field of Search ..... 400/194, 195, 196, 196.1, 400/234, 235.1, 208

[56] References Cited

U.S. PATENT DOCUMENTS

| | | | |
|---|---|---|---|
| 764,342 | 7/1904 | Booth | 400/235.1 X |
| 3,621,968 | 11/1971 | Kondur | 400/196 X |
| 3,941,231 | 3/1976 | Matuck et al. | 400/196.1 |
| 3,977,512 | 8/1976 | Teagarden et al. | 400/195 |
| 3,981,387 | 9/1976 | Gottschlich | 400/195 X |
| 4,033,445 | 7/1977 | Oddicini | 400/208 |
| 4,074,800 | 2/1978 | Steinke | 400/196 X |
| 4,130,367 | 12/1978 | Guerrini et al. | 400/195 |
| 4,156,572 | 5/1979 | Carena | 400/197 X |
| 4,161,270 | 7/1979 | Casey | 400/195 X |

FOREIGN PATENT DOCUMENTS

| | | | |
|---|---|---|---|
| 2148950 | 4/1973 | Fed. Rep. of Germany | 400/196.1 |
| 2758790 | 7/1978 | Fed. Rep. of Germany | 400/196.1 |
| 2816714 | 10/1978 | Fed. Rep. of Germany | 400/195 |
| 1416802 | 12/1975 | United Kingdom | 400/196.1 |

OTHER PUBLICATIONS

IBM Technical Disclosure Bulletin, "Endless Fold Ribbon Cartridge", Gardineer, vol. 15, No. 2, Jul. 1972, p. 543.

IBM Technical Disclosure Bulletin, "Ribbon Cartridge", Mathews, vol. 18, No. 11, Apr. 1976, p. 3538.

*Primary Examiner*—Ernest T. Wright, Jr.

*Attorney, Agent, or Firm*—Wolf, Greenfield & Sacks

[57] ABSTRACT

A cartridge which contains an inked ribbon for use in a high speed printer such as a wire matrix printer and typically driven by a capstan of the printer. The ribbon is arranged in the form of a mobius loop and the cartridge is constructed in a minimal number of components including a cartridge cover and cartridge base together forming a compartment for most of the loop, and a slotted pinch roller. The cover includes an integral pinch roller support post and part of the means for controlling the twist in the mobius loop. The base includes an integral ribbon peeler associated with the pinch roller and the other part of the control means for the loop twist. The cover and base are provided with ribbon guide means to support the ribbon only along a section thereof between the egress and ingress of the loop to the compartment, leaving a relatively long, linear portion of the ribbon unsupported by the cartridge, thus enabling use of the cartridge either in a stationary position or piggybacked to the printing head.

11 Claims, 5 Drawing Figures

HIGH SPEED PRINTER CARTRIDGE

BACKGROUND OF THE INVENTION

The present invention relates in general to a cartridge for a ribbon, tape or the like for use with a high speed printer, and is concerned, more particularly, with a cartridge for an inked ribbon arranged in an endless, preferably a mobius, loop. The cartridge of this invention is constructed for use either in a stationary position relative to the printer or piggybacked to the moving printing head.

Advancements in the field of mini-computer and micro-computer systems have required compatible advances in the devices used to record or print-out computer information. The drastic increase in computer machine speed has resulted in the output information being printed at a much higher rate than was the case several years ago. For example, an IBM typewriter can operate at a speed of approximately three and one-half characters per second. Today, so-called dot matrix printers operate at speeds at approximately 80–300 characters per second. Because of these drastically increased computer print-out speeds, the disposable print-out devices are quite quickly consumed in printing out millions of characters a day. Presently, cartridge-type disposable ribbon systems are utilized to present an inked ribbon between the printing device and the paper or other material upon which the printing is to take place. The disposable devices usually contain several components thus resulting in each cartridge device being relatively expensive. As computer speeds contine to increase, more disposable devices are used each week per machine.

In the past, one means of presenting and cycling the printer ribbon has been a reel-to-reel arrangement, as in a conventional typewriter. With increased performance, which characterizes the present trend in small matrix printers, rates of print delivery have been increased to such an extent that the operators are changing and rethreading the ribbon virtually on a daily basis. It is because of this inconvenience in making changes with the reel-to-reel arrangement, that there has developed a trend in the industry toward the use of disposable (clean-hands) ribbon cartridges, of which there are several examples available on the market.

The known disposable cartridges are generally somewhat complex in construction having a relatively large number of component parts which may typically be in the range of six to ten parts, which makes these cartridges quite expensive. Accordingly, one object of the present invention is to provide an improved cartridge design substantially reducing the number of components comprising the cartridge so that the cost of the cartridge is substantially reduced. In view of today's use of computer equipment, such a reduction in price is quite significant especially when considered over an entire year of operation.

One typical ribbon cartridge is shown in the Matuck, et al U.S. Pat. No. 3,941,231. This patent shows a ribbon cartridge for an endless loop ink ribbon, suitable for use with a wire matrix printer in which the cartridge includes elongated guide members to confine the path of the loop of the ribbon to a predetermined path along its entire exposed length. In Matuck, et al the cartridge is limited in its use to a piggyback position on the printing head and cannot be used in a stationary position as with the cartridge of this invention.

Accordingly, another object of the present invention is to provide a ribbon cartridge that is constructed to permit use of the cartridge either in a stationary position or piggybacked to the printing head.

Other patents that show ribbon cartridge include U.S. Pat. Nos. 3,621,968; 3,833,108; 3,877,561; 3,927,746; 3,985,219; 3,978,965; 3,897,866; 3,830,351; 3,814,231; 3,799,315; 3,804,227; 3,777,871; 3,980,171; 3,904,017; 3,425,531; 3,425,532; 3,356,202; 3,151,724; 3,094,204; 3,045,800; 3,065,837.

A further object of the present invention is to provide a ribbon cartridge having means for supporting a section of the ribbon to provide the twist in the mobius loop path, at the same time providing the necessary tensioning in the ribbon. In this regard in accordance with the invention upper and lower offset ribs are provided for controlling the twist; with the depth of penetration of one rib relative to the other being controlled to in turn control the tension in the ribbon which can be selected to meet certain printer requirements. Thus, there is provided in accordance with the invention a combined means for simultaneously insuring ribbon rotation or twist and at the same time selectively generating ribbon tension without the use of many parts to the cartridge.

Still another object of the present invention is to provide peeler means in association with the pinch roller of the cartridge for properly directing the loop and preventing any snagging of the endless loop.

Still a further object of the present invention is to provide an ink ribbon cartridge wherein the ribbon is capable of withstanding several million characters of printing, is disposable, relatively simple in construction, lightweight, and inexpensive to manufacture.

SUMMARY OF THE INVENTION

To accomplish the foregoing and other objects of this invention there is provided an improved high speed printer ribbon cartridge comprised of preferably a pair of cartridge parts including a cartridge base and a cartridge cover together cooperatively defining a substantially enclosed compartment having an ingress and egress for the ribbon loop therefrom. The ribbon loop is preferably in the form of a mobius loop with substantially all of the loop disposed in the compartment with the exception of a section that is to be presented to the printing head. Means are provided in the cartridge for guiding the loop including means defining a channel adjacent the compartment and leading from the egress from the compartment and, means in the channel for providing a twist in the ribbon loop at the same time maintaining a tension in the loop. In the preferred construction, the cartridge basically comprises only three components including the aforementioned cartridge cover and cartridge base together with a pinch roller that is preferably slotted. The cover comprises an integral pinch roller support post and part of the means for controlling the twist and tension in the mobius loop. The cartridge base preferably includes an integral ribbon peeler associated with the pinch roller which is slotted for the purpose of receiving the peeler, and also the other part of the control means for the loop twist and tension thereof. The cartridge also includes means for receiving drive means of the printer for driving the endless loop with a portion of the loop outside of the compartment being free from any support or guiding thereof.

The means within the channel for directing the ribbon and controlling the tension thereof comprises preferably oppositely directed and spaced guide ribs properly locating the twist of the mobius loop as well as providing tension on the loop at that location so that the ribbon is taut as it approaches the printing head.

In the preferred construction the cartridge is constructed so that its storage compartment has a somewhat elongated shape. Similarly, the channel has a somewhat elongated shape directed preferably transversely to the longitudinal direction of the storage compartment. It is also preferred that the free portion of the moving ribbon be of substantially the same length as the length of the storage compartment and also be of sufficient length to enable the cartridge to be used in a stationary position.

In operation, a capstan which is preferably slotted having associated therewith a peeler is pressed against the pinch roller which is also preferably slotted to receive a peeler. The inked ribbon passes between the capstan and pinch roller. The capstan is driven by the printing device and thus causes the inked ribbon to move past the printing head at the same time moving the loop through the ingress to the storage compartment so that the loop can accumulate therein. At the egresss of the storage compartment, the loop passes through the channel. The necessary tension or tautness of the ribbon downstream of the printing head is obtained by the arrangement of ribbon directing elements or ribs located within the aforesaid channel of the cartridge. The ribbon loop is essentially stuffed in the storage compartment in a random fashion and is controlled at the input to the compartment by means of the capstan and pinch roller arrangement, and at the output of the compartment by means of the channel and its associated guide construction. The entire cartridge is held in position preferably by two thrust rollers which are a part of the printing device and permit the drive capstan to exert the required force to move the ink ribbon.

BRIEF DESCRIPTION OF THE DRAWING

Numerous other objects, features and advantages of the invention should now become apparent upon a reading of the following detailed description taken in conjunction with the accompanying drawing, in which.

DETAILED DESCRIPTION

Figure 1:
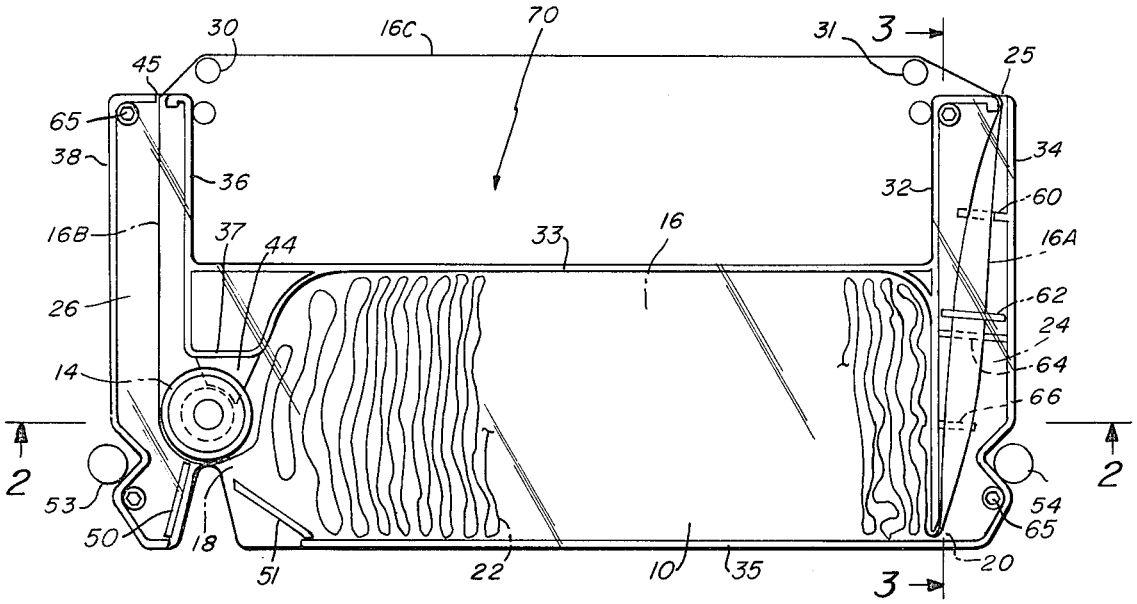
FIG. 1 is a plan view of a preferred construction of the device of this invention.
Figure 2:
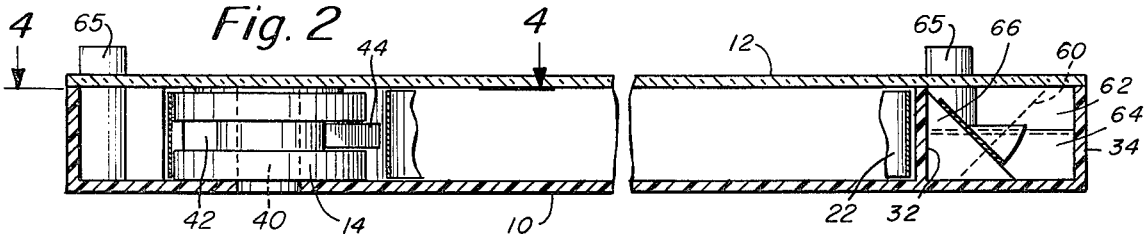
FIG. 2 is a cross-sectional view taken along line 2—2 of the device shown in FIG. 1.

The drawing shows a preferred embodiment of the cartridge of the present invention comprising a cartridge base 10, a cartridge cover 12, and a pinch roller 14. The cover 12 and base 10 have walls 33, 35 and U-shaped wall 37 extending therebetween and define a storage area 16 that is of substantial size and of somewhat elongated shape having an inlet at 18 and an outlet at 20 from the storage area 16. The storage area 16 is also partially defined by wall 32 and bulkhead portion 51. An inked printing ribbon 22 is stored within the storage area 16 and is arranged in the form of an endless mobius loop. The majority of the length of ribbon 22 is stored in the area 16 with a section 16A within the egress channel 24 and a section 16B within the ingress channel 26. A further portion 16C of the ribbon 22 is supported freely between guideposts 30 and 31.

The egress channel 24 is defined by portions of the cover 12 and base 10 and also the upright walls 32 and 34. Similarly, the ingress channel 26 is defined in part by the cover 12 and base 10 and the upright walls 36 and 38. The channels 24 and 26 extend in the form of legs from the main storage area 16 portion of the cartridge to define a substantially U-shaped cartridge as depicted in FIG. 1. Preferably, the length of the section 16C, which is the length presented to the printing head, is on the order of the length of the storage area or compartment 16. The length of the portion 16C is also sufficiently long to enable the cartridge to be maintained stationary relative to the printing head if so desired.

It is also preferred that the channels 24 and 26 have a somewhat elongated shape, with the channel 24 extending substantially transversely to the longitudinal direction of the storage area 16.

Figure 4:
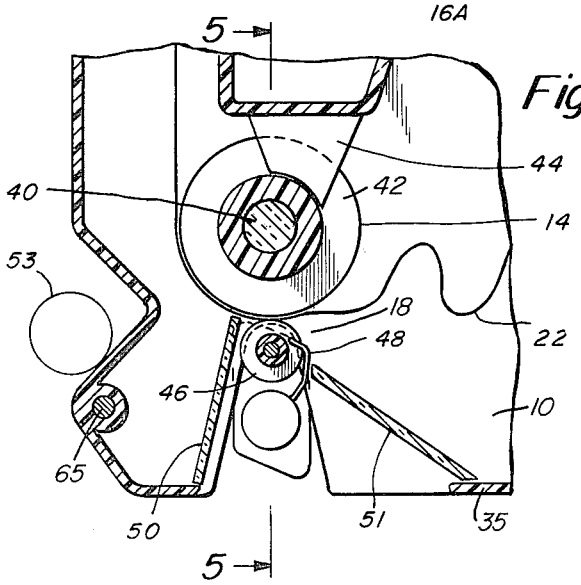
FIG. 4 is a somewhat enlarged fragmentary view of the capstan and pinch roller arrangement as taken along the line 4—4 of FIG. 2.
Figure 5:
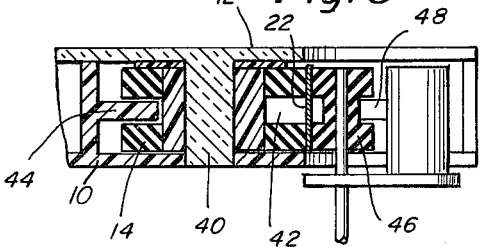
FIG. 5 is a further cross-sectional view taken along line 5—5 of FIG. 4.

As depicted in FIG. 1, the ribbon 22 extending over guide post 30 passes into the ingress channel 26 and is supported between the channel 26 and the storage area 16 about the slotted pinch roller 14. FIGS. 4 and 5 show the pinch roller 14 supported by means of post 40 which is integral with the cartridge cover 12. The roller 14 has a circumferential slot 42 which receives the peeler 44 extending into a portion of the slot 42. The peeler 44 prevents the inked ribbon 22 from becoming tangled at the inlet 18 to the storage area 16.

FIGS. 4 and 5 also show the ribbon 22 being urged by and driven by the capstan 46 which comprises a part of the printing machine not shown in any detail herein. The capstan 46 is also preferably slotted for receiving a peeler 48 which also prevents any binding or tangling of the ribbon 22 at the inlet 18 to the storage area 16.

The inked ribbon 22 enters the channel 26 through a slot 45 which is wide enough to permit the ribbon 22 to pass therethrough without squeezing the ribbon 22 as this would possibly squeeze some of the ink out of the ribbon 22. As the ribbon 22 passes between the slotted pinch roller 14 and the capstan 46, the ribbon 22 is prevented from entangling by means of the peelers 44 and 48. As previously mentioned the capstan 46 is preferably not a part of the cartridge itself but is a portion of the printing machine. To accommodate the capstan 46 and its associated peeler 48, the cartridge is designed with bulkhead portions 50 and 51 which form guides for the capstan 46 permitting the capstan 46 to be securely pressed against the pinch roller 14. The tension of the capstan 46 drive roller is maintained against the pinch roller 14 by positioning the cartridge against the thrust rollers 53 and 54 depicted in FIG. 1. These rollers 53 and 54 are also preferably a part of the printing machine, as are the guide posts 30 and 31.

After the inked ribbon 22 is driven into the storage area 16, it is stored therein in random loops. FIG. 1 shows some such loops, however, in actual practice it is preferred that the loop be constructed as long as possible and thus the loops would actually be bunched together more tightly. The ribbon 22 is then drawn through the slot 20 into the egress channel 24 where the twist in the loop is maintained and controlled.

Figure 3:
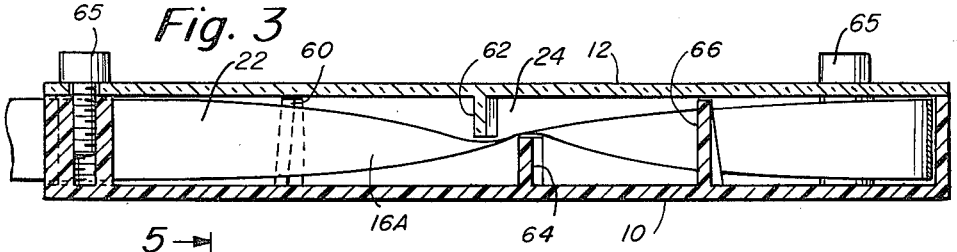
FIG. 3 is a cross-sectional view taken along line 3—3 of the device shown in FIG. 1.

The twist in the mobius loop is controlled within the channel 24 by means of four ribs 60, 62, 64, 66, three of which extend upwardly from the base 10 with the fourth rib 62 extending downwardly from the cover 12. The first rib 66 extends integrally from the base 10 and has a tapered wall for positioning and defining the initial twist for the ribbon 22. Next, the ribbon 22 passes, as depicted in FIG. 3, between the ribs 62 and 64 which extend in opposite directions from the cover 12 and base 10, respectively. The ribs 62 and 64 are off-set from each other so that they cause the ribbon 22 to follow a shallow "s" path as the ribbon 22 passes through the ribs 62 and 64. The relative depth of penetration between the ribs 62 and 64 is controlled to provide a predetermined drag on the ribbon 22. The degree of drag, as determined by all of the ribs 60, 62, 64 and 66 as well as the entrance and exit from the channel 24, may be controlled to correspond with the specific requirements of the printer that is being used. The final rib 60 extends from the base 10 and is sloped in the opposite direction to the slope of rib 66. The ribs 60 and 66 cause the ribbon 22 to rotate about its axis and thus locate the twist which in a sense is confined at the ribs 62 and 64. The ribbon 22 then exits from the channel 24 through the slot 25.

The relatively long free-run, 16C, of the ribbon 22 between the channels 24 and 26 supported by posts 30 and 31, provides for the insertion of various printer heads in the printer head area shown generally by the reference character 70. The length of the run 16C can be adjusted to any desired length sufficient to receive the printing device which impacts the printer ribbon 22 against the paper or the like. In another embodiment of the invention, the distance of the length 16C or the distance between the channels 24 and 26 can be made closer thereby making the cartridge more compact in which case the cartridge is moved in unison with the printer head. In the embodiment of FIG. 1 it is preferred that the cartridge be stationary with the printer head moving along the continuously moving section 16C of the inked ribbon 22.

One of the important features of the present invention is concerned with the means used for twisting the mobius loop and at the same time maintaining a predetermined tension in the loop. In the past cartridges used a metal spring bearing upon the ribbon 22 at a point close to the exit from the cartridge body in order to provide tension on the ribbon 22 during operation. This required the use of a separate metal spring, whereas, in accordance with the present invention the necessary tension is provided primarily by the improved rib construction of this invention. In this connection the ribs 62 and 64 are preferably off-set by a distance on the order of 1/16th inch. Preferably, additional ribs such as 60 and 66 are used in addition to the basic ribs 62 and 64. In addition to the spacing between ribs 62 and 64 the relative depth of penetration or overlap between these ribs 62 and 64 is also significant in controlling the tension of the ribbon 22. Also, it is preferred that the ribbon 22 extend into the channel 24 at a 90° angle to the longitudinal direction of the channel 24, and also exit at a similar angle from the channel 24. In this way the walls 32, 34 defining the slots 20 and 25 also provide some amount of tension so as to keep the ribbon 22 taut in the printing area 70. Also, although only two ribs 60 and 66 have been shown additional ribs may be used especially if it is desired to provide additional drag on the ribbon 22. Thus, in some embodiments there may be a total of six or even eight ribs that are used in the channel 24.

The cover 12 and base 10 may be secured together in any well known manner. In the drawing there are shown a number of screws 65, one detail of which is shown in the cross-sectional view of FIG. 3.

Having described one preferred embodiment of the present invention, it should now become apparent to those skilled in the art that numerous other embodiments are contemplated as falling within the scope of this invention which is to be defined by the appended claims:

What is claimed is:

1. A ribbon cartridge for use with a high speed printer comprising:

cartridge defining parts including at least a cover and base together cooperatively defining a substantially enclosed ribbon storage compartment, said ribbon storage compartment also being defined by upright walls extending between the cover and base and at least in part defining a compartment inlet and a compartment outlet, an endless ribbon loop, the majority of which is disposed in the compartment, means, including at least in part the cover and base, defining an ingress channel leading to the inlet of the compartment at the inlet end of the compartment and extending transverse to the length of the compartment and defining an ingress leg with a free end spaced from the compartment, means, including at least in part the cover and base, defining an egress channel leading from the outlet of the compartment at the outlet end of the compartment extending transverse to the length of the compartment and defining an egress leg with a free end spaced from the compartment, said ingress and egress legs at their free end forming a support for the ribbon with the ribbon free from support therebetween, the length of the support free section of ribbon being comparable to the length of the storage compartment to maximize said free section length, means in said egress channel for providing a 180° rotation of said ribbon as said ribbon traverses through the egress channel, said means for providing rotation comprising a pair of centrally disposed ribs each extending in opposite directions, one rib from the base and the other rib from the cover, said ribs being each of a height on the order of one-half the channel height and spaced along the egress channel with a small gap therebetween, said means for rotation further comprising end ribs, one end rib at each end of the egress channel and having opposite sloped walls, and means for receiving drive means of the printer for driving the endless ribbon loop including a pinch roller means disposed directly at and in part defining the compartment inlet, said upright walls including a U-shaped wall extending between the cover and base and having the pinch roller means supported adjacent thereto, said cover and base being notched to receive said drive means, said notch and U-shaped wall being disposed on opposite sides of said pinch roller means.

2. A ribbon cartridge as set forth in claim 1 including peeler means associated with the pinch roller means for preventing tangling of the ribbon entering the storage compartment.

3. A ribbon cartridge as set forth in claim 2 wherein said pinch roller means is slotted to receive said peeler means.

4. A ribbon cartridge as set forth in claim 1 including separate bulkhead walls diverging toward the pinch roller means, one bulkhead wall disposed along one side of the notch in the ingress channel and the other bulkhead wall disposed along the other side of the notch in the ribbon storage compartment.

5. A ribbon cartridge as set forth in claim 4 wherein said centrally disposed ribs are spaced about 1/16 inch.

6. A ribbon cartridge as set forth in claim 1 wherein said U-shaped wall also in part defines the ingress channel.

7. A ribbon cartridge as set forth in claim 6 including a further upright wall that is straight extending to form one side of the egress channel and having a portion of its length defining an end of the ribbon storage compartment.

8. A ribbon cartridge as set forth in claim 1 wherein the free end of both ingress and egress channels includes an end wall transverse to the length of said ingress and egress channels having means defining an aperture in each end wall for passage of the ribbon.

9. A ribbon cartridge for use with a high speed printer comprising;

cartridge defining parts including at least a cover and base together cooperatively defining a substantially enclosed ribbon storage compartment, said ribbon storage compartment also being defined by upright walls extending between the cover and base and at least in part defining a compartment inlet and a compartment outlet, an endless ribbon loop, the majority of which is disposed in the compartment, means, including at least in part the cover and base, defining an ingress channel leading to the inlet of the compartment at the inlet end of the compartment and extending transverse to the length of the compartment and defining an ingress leg with a free end spaced from the compartment, means, including at least in part the cover and base, defining an egress channel leading from the outlet of the compartment at the outlet end of the compartment and extending transverse to the length of the compartment and defining an egress leg with a free end spaced from the compartment, said ingress and egress legs at their free end forming a support for the ribbon with the ribbon free from support therebetween, means in said egress channel for providing a 180° rotation of said ribbon as said ribbon traverses through the egress channel, and means for receiving drive means of the printer for driving the endless ribbon loop including a pinch roller means disposed at and in part defining the compartment inlet, said upright walls including a U-shaped wall extending between the cover and base and having the pinch roller means supported adjacent thereto, said cover and base being notched to receive said drive means, said notch and U-shaped wall being disposed on opposite sides of said pinch roller means.

10. A ribbon cartridge for use with a high speed printer comprising;

cartridge defining parts including at least a cover and base together cooperatively defining a substantially enclosed ribbon storage compartment, said ribbon storage compartment also being defined by upright walls extending between the cover and base and at least in part defining a compartment inlet and a compartment outlet, an endless ribbon loop, the majority of which is disposed in the compartment, means, including at least in part the cover and base, defining an ingress channel leading to the inlet of the compartment at the inlet end of the compartment and extending transverse to the length of the compartment and defining an ingress leg with a free end spaced from the compartment, means, including at least in part the cover and base, defining an egress channel leading from the outlet of the compartment at the outlet end of the compartment and extending transverse to the length of the compartment and defining an egress leg with a free end spaced from the compartment, said ingress and egress legs at their free end forming a support for the ribbon with the ribbon free from support therebetween, means in said egress channel for providing a 180° rotation of said ribbon as said ribbon traverses through the egress channel, means for receiving drive means of the printer for driving the endless ribbon loop including a pinch roller means disposed at and in part defining the compartment inlet and a drive capstan, said cover and base being notched to receive said drive capstan, said notch terminating adjacent the pinch roller means, and separate bulkhead walls diverging toward the pinch roller means, one bulkhead wall disposed along one side of the notch in the ingress channel and the other bulkhead wall disposed along the other side of the notch in the ribbon storage compartment.

11. A ribbon cartridge for use with a high speed printer comprising;

cartridge defining parts including at least a cover and base together cooperatively defining a substantially enclosed ribbon storage compartment, said ribbon storage compartment also being defined by upright walls extending between the cover and base and at least in part defining a compartment inlet and a compartment outlet, an endless ribbon loop, the majority of which is disposed in the compartment, means, including at least in part the cover and base, defining an ingress channel leading to the inlet of the compartment at the inlet end of the compartment and extending transverse to the length of the compartment and defining an ingress leg with a free end spaced from the compartment, means, including at least in part the cover and base, defining an egress channel leading from the outlet of the compartment at the outlet end of the compartment and extending transverse to the length of the compartment and defining an egress leg with a free end spaced from the compartment, said ingress and egress legs at their free end forming a support for the ribbon free from support therebetween, means in said egress channel for providing a 180° rotation of said ribbon as said ribbon traverses through the egress channel, means for receiving drive means of the printer for driving the endless ribbon loop including a pinch roller means disposed at and in part defining the compartment inlet and a drive capstan, said upright walls including a relatively short wall segment including a side surface facing the pinch roller means and having peeler means integrally extending from said facing side surface spaced intermediate the cover and base, said cover and base being notched to receive said drive capstan, said notch and relatively short wall segment being disposed on opposite sides of said pinch roller means, and said pinch roller means having a peripheral slot to receive said peeler means.

* * * * *